US005743170A

United States Patent [19]

Pascual et al.

[11] Patent Number: 5,743,170

[45] Date of Patent: Apr. 28, 1998

[54] DIAPHRAGM MECHANISM FOR AN AIR DRIVEN DIAPHRAGM PUMP

[75] Inventors: Wilfred D. Pascual, Baldwin Park; Eric L. Forman, Rancho Cucamonga, both of Calif.

[73] Assignee: Wilden Pump & Engineering Co., Grand Terrace, Calif.

[21] Appl. No.: 622,943

[22] Filed: Mar. 27, 1996

[51] Int. Cl.[6] ..... F01B 19/00

[52] U.S. Cl. ..... 92/103 F; 92/103 SD

[58] Field of Search ..... 92/96, 98 R, 99, 92/100, 103 R, 103 F, 103 SD

[56] References Cited

U.S. PATENT DOCUMENTS

| | | | |
|---|---|---|---|
| D. 275,858 | 10/1984 | Wilden | D15/7 |
| D. 294,946 | 3/1988 | Wilden | D15/7 |
| D. 294,947 | 3/1988 | Wilden | D15/7 |
| 2,564,693 | 8/1951 | Hornbostel | 92/103 F X |
| 2,684,829 | 7/1954 | McFarland, Jr. | 92/103 F X |
| 3,071,118 | 1/1963 | Wilden | 121/157 |
| 4,238,992 | 12/1980 | Tuck, Jr. | 92/103.5 |
| 4,247,264 | 1/1981 | Wilden | 417/393 |
| 4,270,441 | 6/1981 | Tuck, Jr. | 92/102 |
| 4,549,467 | 10/1985 | Wilden et al. | 91/307 |
| 4,717,117 | 1/1988 | Cook | 251/61.1 |
| 4,989,497 | 2/1991 | Lerma | 92/103 |
| 5,169,296 | 12/1992 | Wilden | 417/395 |
| 5,213,485 | 5/1993 | Wilden | 417/393 |
| 5,291,822 | 3/1994 | Alsobrooks | 92/93 |
| 5,560,279 | 10/1996 | Connors | 92/8 |

*Primary Examiner*—Hoang Nguyen
*Attorney, Agent, or Firm*—Lyon & Lyon LLP

[57] ABSTRACT

A flexible diaphragm for an air driven diaphragm pump having a circular configuration with an inner attachment portion, an outer attachment portion and an annular flexure portion bounded by transition portions to the inner and outer attachment portions. The annular flexure portion is configured with a constant radius of curvature concave on the air chamber side. The curvature is such that the center of curvature lies substantially within a plane also including the transition portion between the annular flexure portion and the inner attachment portion. The diaphragm is molded in this shape to avoid the creation of internal stress and permanent strain resulting from use of the diaphragm. Fabric is positioned across the diaphragm closest to the air chamber side and being about one-third of the total thickness of the diaphragm from the air chamber side of the diaphragm.

7 Claims, 6 Drawing Sheets

DIAPHRAGM MECHANISM FOR AN AIR DRIVEN DIAPHRAGM PUMP

BACKGROUND OF THE INVENTION

The field of the present invention is air driven diaphragm pumps.

Pumps having double diaphragms driven by compressed air directed through an actuator valve are well known. Reference is made to U.S. Pat. No. 5,213,485; U.S. Pat. No. 5,169,296; U.S. Pat. No. 4,247,264; U.S. Pat. No. Des. 294,946; U.S. Pat. No. Des. 294,947; and U.S. Pat. No. Des. 275,858, the disclosures of which are incorporated herein by reference. Actuator valves operated on a feedback control system employable with the foregoing pumps are disclosed in U.S. Pat. No. 4,549,467 and in U.S. Pat. No. 3,071,118, the disclosures of which are also incorporated herein by reference. These feedback control systems have been employed with the double diaphragm pumps illustrated in the other patents. Diaphragms for such pumps are disclosed in U.S. Pat. No. 4,270,441 and in U.S. Pat. No. 4,238,992, the disclosures of which are incorporated herein by reference.

Such pumps include an air chamber housing having a center section and two concave discs facing outwardly from the center section. Opposing the two concave discs are pump chamber housings. The pump chamber housings are coupled with an inlet manifold and an outlet manifold through ball check valves positioned in the inlet passageways and outlet passageways from and to the inlet and outlet manifolds, respectively. Diaphragms extend outwardly to mating surfaces between the concave discs and the pump chamber housings. The diaphragms with the concave discs and with the pump chamber housings each define an air chamber and a pump chamber to either side thereof. At the centers thereof, the diaphragms are fixed to a control shaft by pump pistons. The control shaft slidably extends through the air chamber housing.

Actuator valves associated with such pumps include feedback control mechanisms. Such mechanisms typically have airways on the control shaft attached to the diaphragms and a valve piston. Pressurized air is supplied to the valve piston. This pressurized air is alternately distributed to the air chambers through the valve piston. The valve piston is controlled by control shaft or pump piston location which in turn is controlled by distribution of air through the valve piston. The resulting alternating pressurized air drives the diaphragms back and forth. In turn, the pump chambers alternately expand and contract to pump material therethrough. Such pumps are capable of pumping a wide variety of materials of greatly varying consistency.

The diaphragms used in such pumps have been made in a number of shapes. A typical design includes an outer attachment portion formed as a large circular bead which fits within opposed channels in the air chamber housing and the pump chamber housing, respectively. Small lip seals may be found on the bead to insure a proper seal. Centrally located in the diaphragm is an inner attachment portion. This portion receives the pump piston, usually presented in two parts to either side of the inner attachment portion and held together by the control shaft. An annular flexure portion is positioned between the inner and outer attachment portions and joined to these attachment portions by transition portions. It is typically the annular flexure portion which varies in design. A recent such flexure portion shape has been a section of a sphere. These are typically referred to as dome diaphragms.

It has been found that dome diaphragms exhibit permanent deformation upon extended use. This permanent deformation is understood to leave stress and weakness in the resulting configuration. The shape assumed is one of constant radius of curvature as seen in radial cross section. The locus of the center of curvature of the constant radius of curvature about the annular section in such diaphragms defines a circle lying in a plane which also includes the intersection between the inner attachment portion and the transition portion. When fabric reinforcing has been used, it typically is placed centrally in the body of the diaphragm. The unsupported air chamber side of such diaphragms has been noted to crack under the tension imposed. This can lead to intrusion of moisture into the fibers from the air and ultimate delamination of the diaphragm. Also, wear on the pump chamber side from abrasive pumped materials has been found to lead to fabric failure and rupture of the resulting unsupported diaphragm.

SUMMARY OF THE INVENTION

The present invention is directed to diaphragm mechanisms for air driven diaphragm pumps. The shape of the diaphragm includes an annular flexure portion which assumes the shape of a domed diaphragm after full and permanent strain has occurred. By forming the diaphragm in this shape, residual stresses and unwanted strain damage is avoided. In a separate aspect of the invention, fabric reinforcing is placed near the air chamber side of the diaphragm to reduce tension failure on the air chamber side and protect the fabric from abrasion to a greater extent.

Accordingly, it is a principal object of the present invention to provide an improved diaphragm mechanism for reciprocal air driven pumps. Other and further objects and advantages will appear hereinafter.

DETAILED DESCRIPTION OF THE PREFERRED EMBODIMENT

Figure 1:
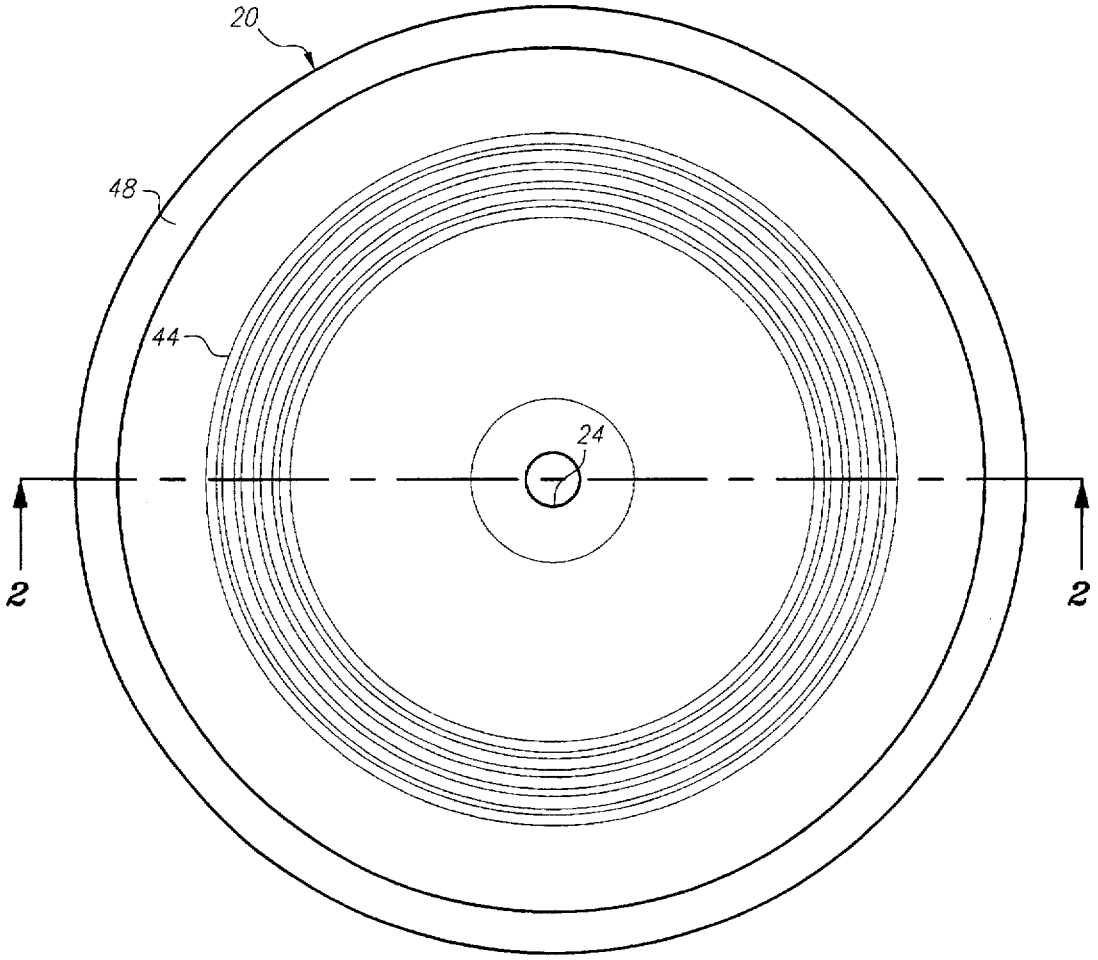
FIG. 1 is a plan view of a first diaphragm.
Figure 2:
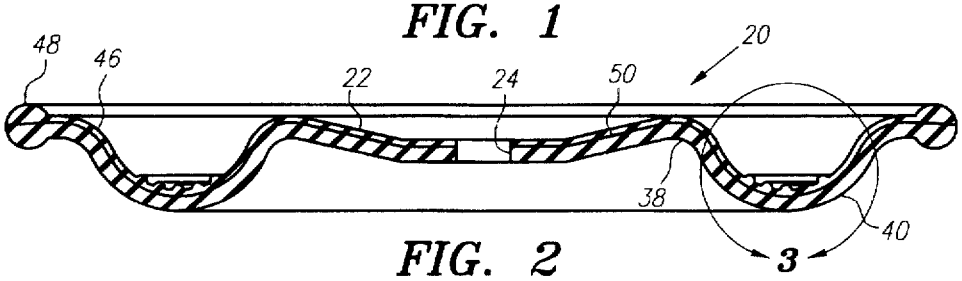
FIG. 2 is a cross-sectional view of the diaphragm of FIG. 1 taken along line 2—2 of FIG. 1.
Figure 3:
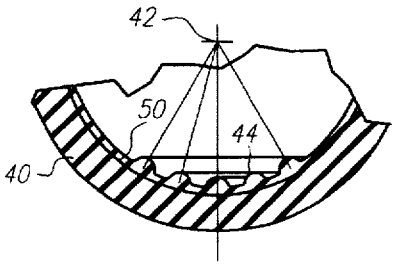
FIG. 3 is a cross-sectional detail of the diaphragm of FIG. 1 which is the portion indicated by note 3 in FIG. 2.

Turning in detail to the drawings, a diaphragm mechanism is illustrated in three embodiments. Each of the embodiments is for a separate size of pump. Otherwise, they are understood to be substantially equivalent for purposes here. Consequently, reference numerals are identical for each and only one description is here presented.

A diaphragm, generally designated 20, is of molded construction. The diaphragm 20 includes an air chamber side and a pump chamber side as employed in an air driven diaphragm pump. Such diaphragms may be of chloroprene, nitrile, ethylene propylene or fluorocarbon, all of which are currently found in existing diaphragms. The diaphragm 20 is shown to include an inner attachment portion 22. The inner attachment portion 22 is shown to be molded in a configuration such that in the relaxed state it conforms to associated diaphragm pistons. Further, a hole 24 extends centrally through the inner attachment portion 22 such that a diaphragm piston may be easily assembled with the diaphragm.

Figure 4:
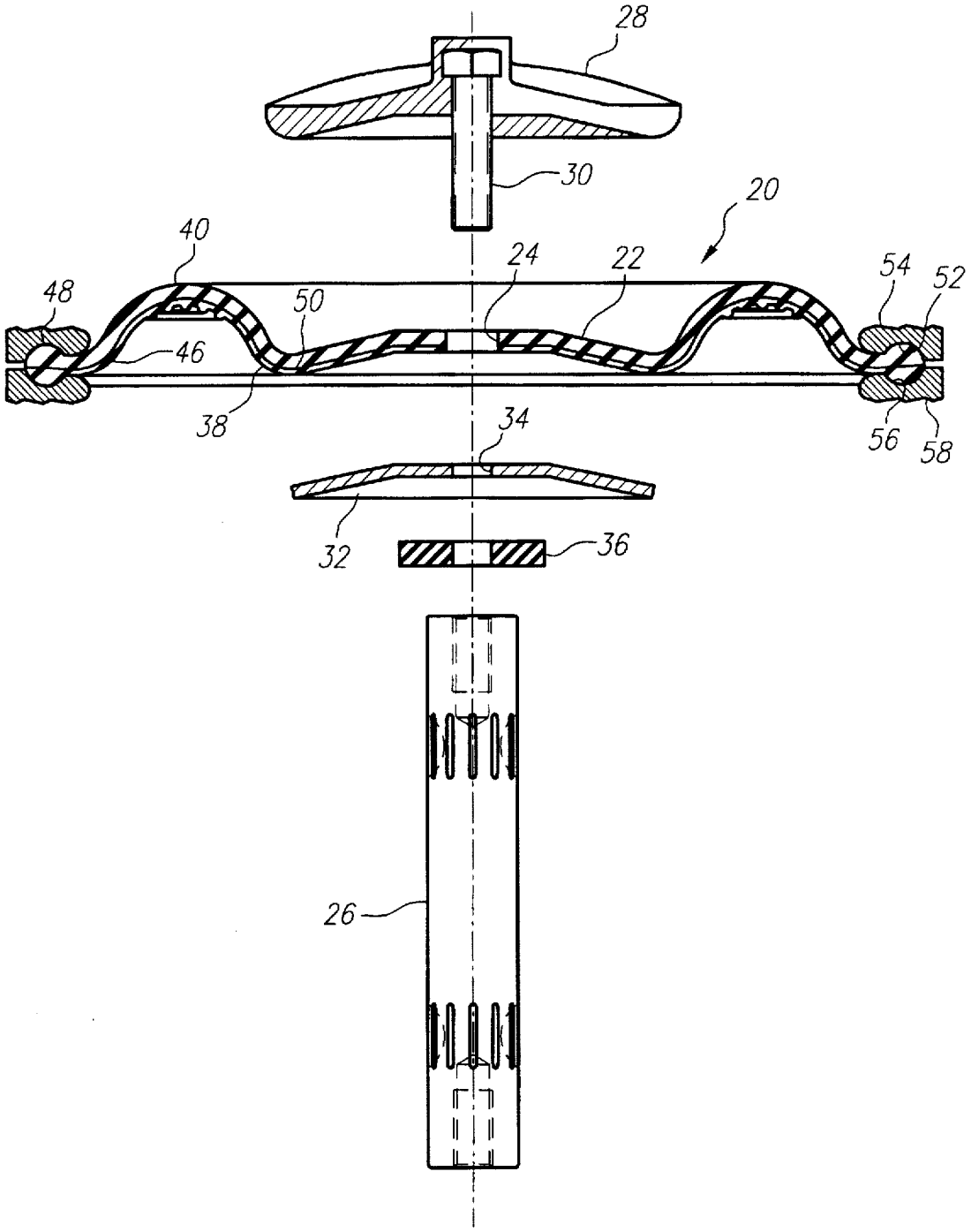
FIG. 4 is an exploded view of a diaphragm mechanism including the diaphragm of FIG. 1 illustrated in cross section.
Figure 8:
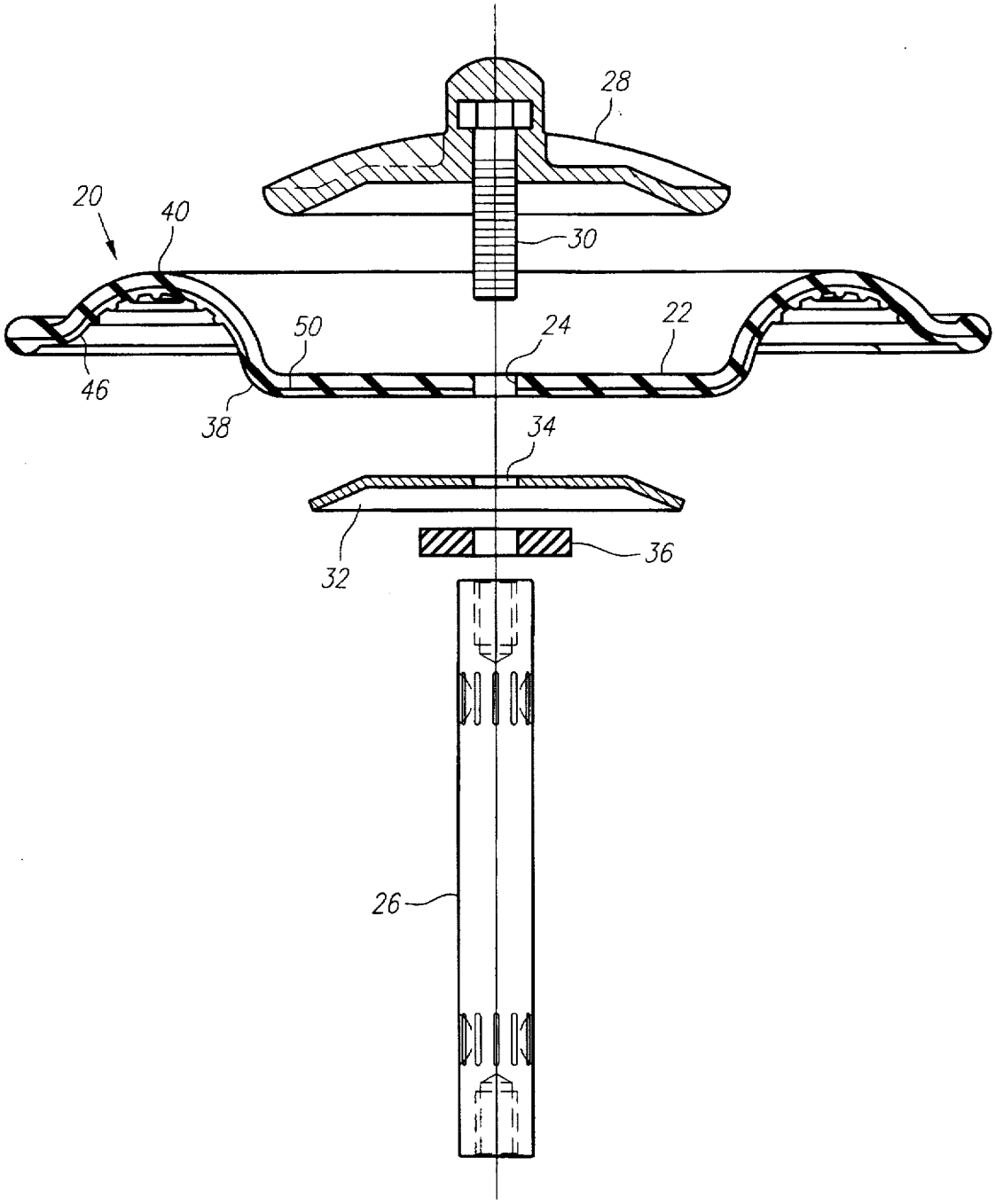
FIG. 8 is an exploded view of a diaphragm mechanism including the diaphragm of FIG. 5 illustrated in cross section.
Figure 12:
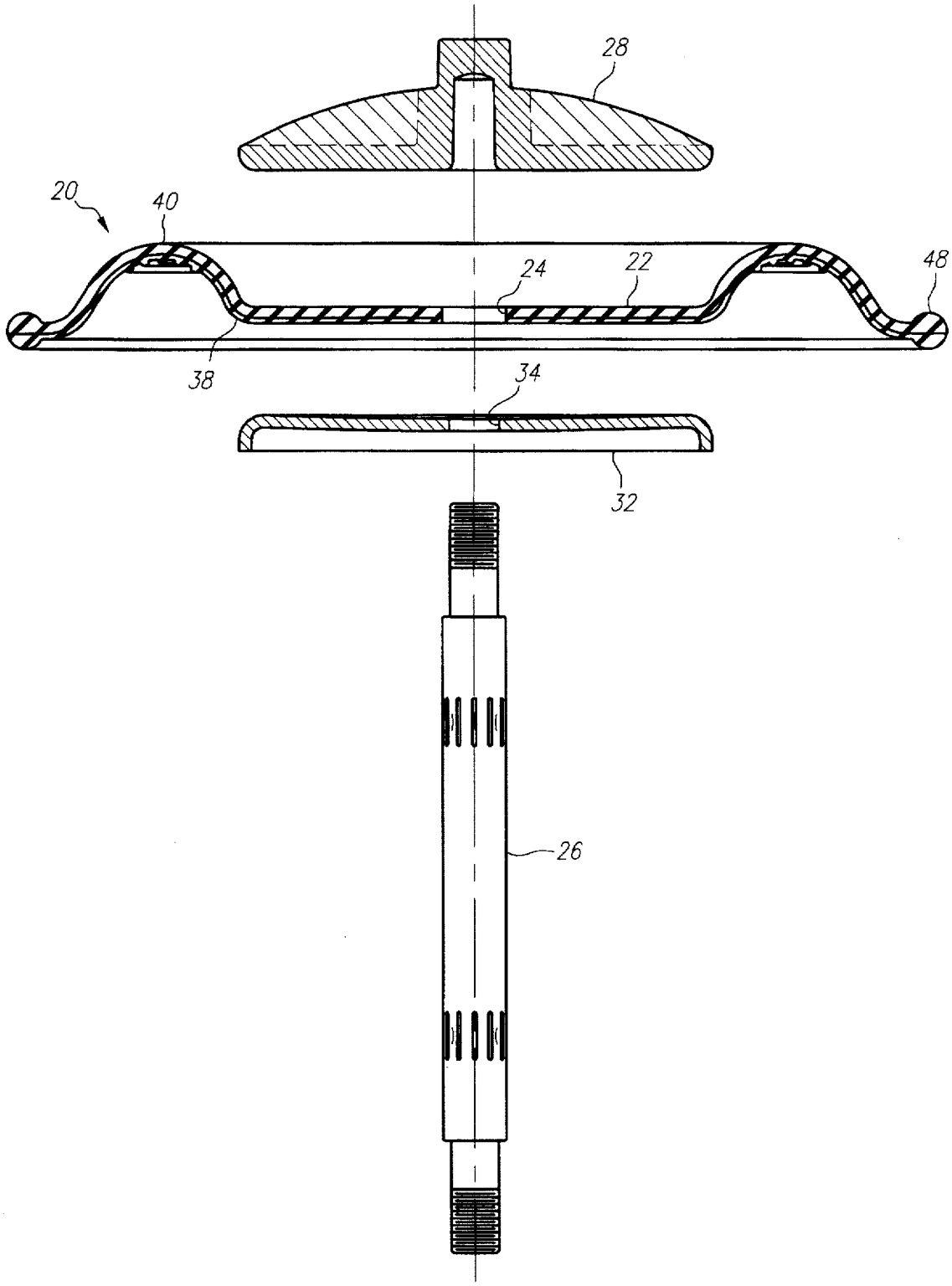
FIG. 12 is an exploded view of a diaphragm mechanism including the diaphragm of FIG. 9 illustrated in cross section.

The diaphragm pistons illustrated in FIGS. 4, 8 and 12 are associated with a control rod 26 and include inner and outer members. In FIGS. 4 and 8, the outer member 28 includes a bolt 30 associated therewith. In FIG. 12, the control rod 26 provides a threaded element cooperating with a threaded hole in the outer member 28. The outer member 28 is shown to have an extended flange with a rounded periphery so as to best accommodate the diaphragm 20 throughout its flexure. An inner member 32 includes a central hole 34 and may be dished or have a curved periphery, again to accommodate the diaphragm through its flexure. The mechanisms of FIGS. 4 and 8 differ from the mechanism of FIG. 12 in that a flexible washer 36 is provided in the devices of FIGS. 4 and 8. The mechanisms of FIGS. 4 and 8 are smaller embodiments than that of FIG. 12.

Outwardly of the inner attachment portion 22 is an inner transition portion 38. The inner transition portion 38 is fully about the periphery of the inner attachment portion 22 and provides a transition to the flexure portion of the diaphragm. This inner transition portion 38 conveniently is configured with a constant radius of curvature which conforms to the outer periphery of the outer member 28 in the relaxed state.

Figure 5:
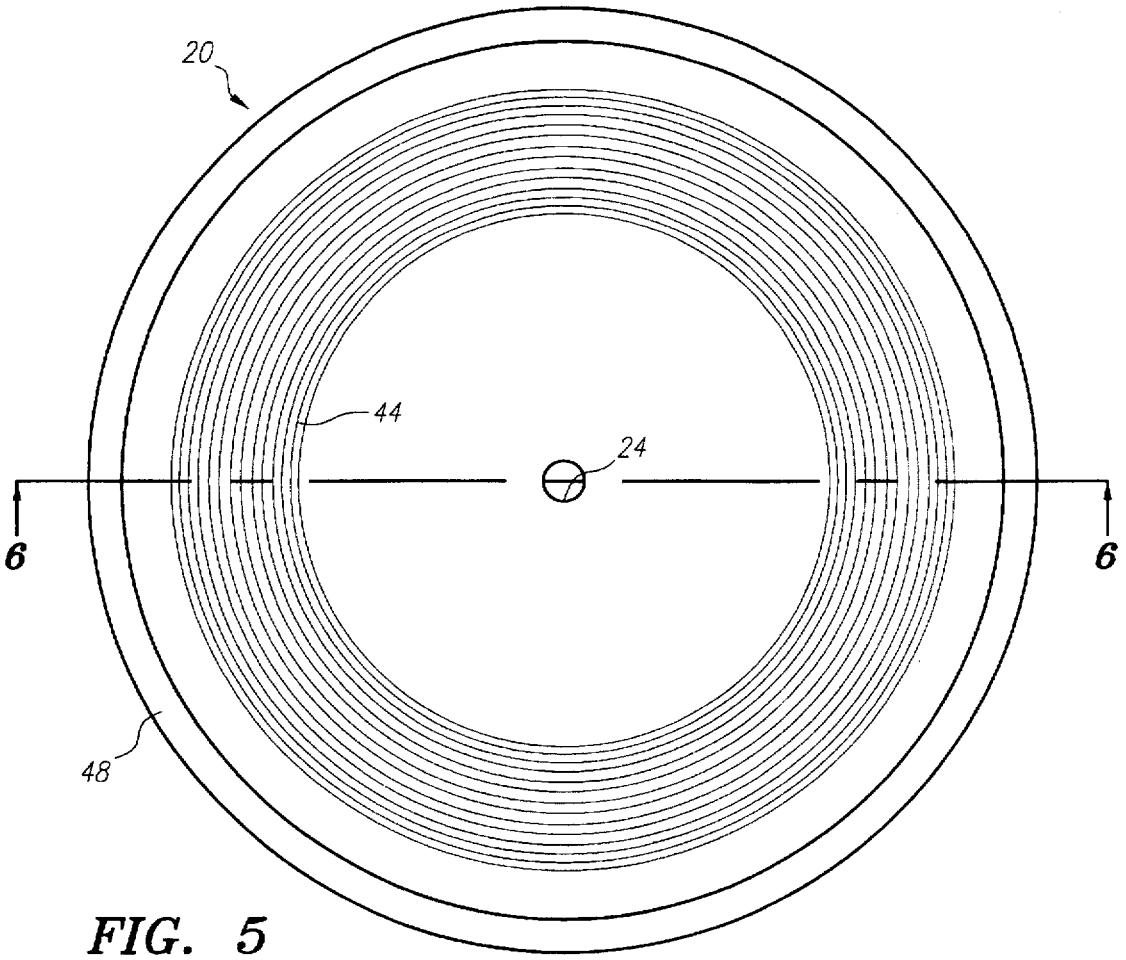
FIG. 5 is a plan view of a second diaphragm.
Figure 6:
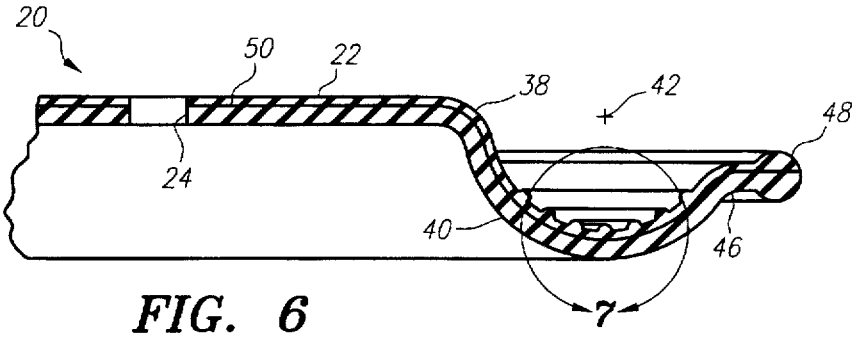
FIG. 6 is a cross-sectional view of the diaphragm of FIG. 5 taken along line 6—6 of FIG. 5.
Figure 7:
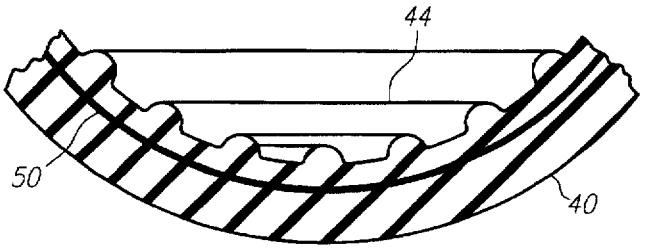
FIG. 7 is a cross-sectional detail of the diaphragm of FIG. 5 which is the portion indicated by note 7 in FIG. 6.
Figure 9:
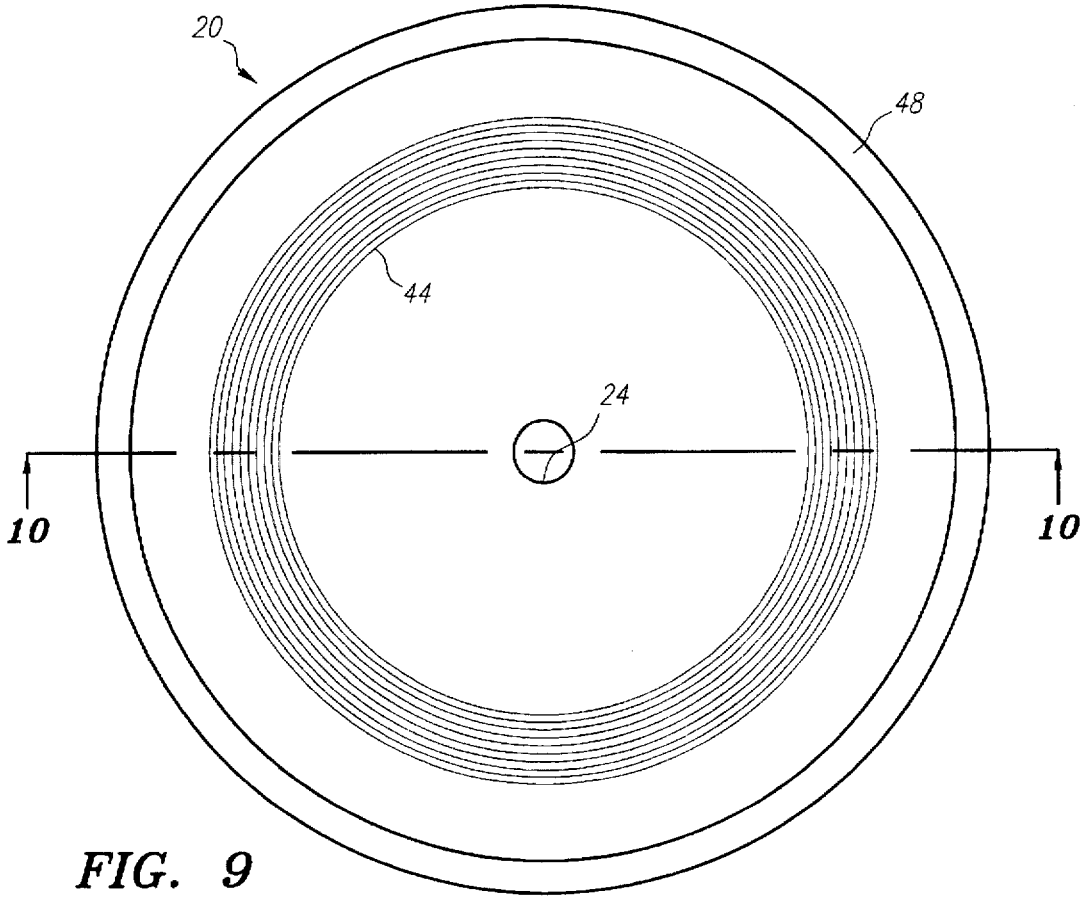
FIG. 9 is a plan view of a third diaphragm.
Figure 10:
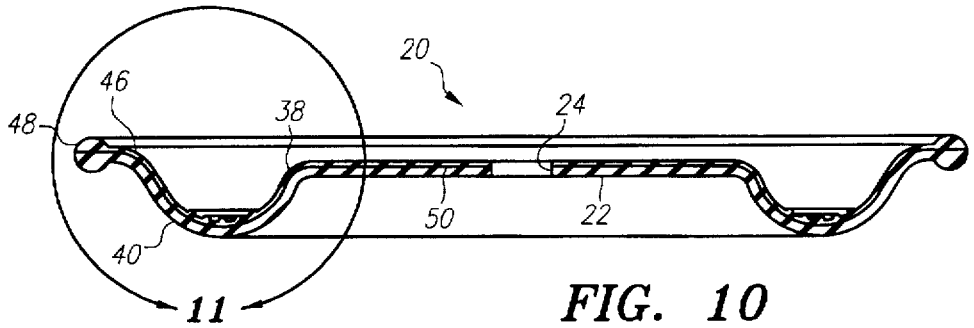
FIG. 10 is a cross-sectional view of the diaphragm of FIG. 9 taken along line 10—10 of FIG. 9.
Figure 11:
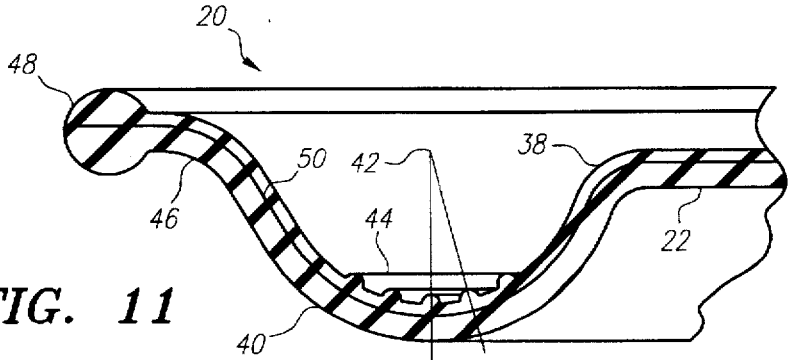
FIG. 11 is a cross-sectional detail of the diaphragm of FIG. 8 which is the portion indicated by note 11 in FIG. 10.

Outwardly of the inner transition portion 38 is an annular flexure portion 40. The inner transition portion 38 joins the inner attachment portion 22 with this annular flexure portion 40. The annular flexure portion 40 is concave to the air chamber side of the diaphragm 20 and, seen in the radial cross section appearing in all Figures except FIGS. 1, 5 and 9, the annular flexure portion 40 has a constant radius of curvature. As the portion 40 is annular, a locus of the center of curvature of the constant radius of curvature is found to be a circle displaced from the air chamber side. The curvature is significant such that the locus of the center of curvature lies substantially in the plane of the inner transition portion 38 as can be seen by the indication of the center points 42. Ribs 44 on the concave side of the annular flexure portion 40 extend fully about the diaphragm 20 and resist bending about radial lines when the diaphragm is stretched so as to avoid cracking.

Outwardly of the annular flexure portion 40 is an outer transition portion 46. The outer transition portion 46 is also conveniently constructed about a constant radius of curvature. This outer transition portion 46 joins the annular flexure portion 40 with the peripheral attachment.

A peripheral attachment is provided by an outer attachment portion 48. This portion 48 includes a bead received by the pump structure.

The diaphragm 20 is molded in the configuration shown so as to provide a structure which is unstressed and not subjected to permanent strain when in the neutral position. Fabric 50 extends through the diaphragm 20 and has been molded in place with the diaphragm. The fabric of the preferred embodiment is 10 oz/in$^2$ black nylon with 30 by 30 knots/in weave. The fabric 50 is shown to lie at approximately one-third of the diaphragm thickness from the air chamber side. This arrangement is of greatest importance where the principal stress is experienced by the diaphragm and also where abrasion on the pump chamber side of the diaphragm is likely to occur.

The structure of the pump interfacing with the diaphragm 20 includes a channel 52 in the pump chamber structure 54 and a similar channel 56 in the air chamber structure 58. The structures 54 and 58 are clamped together about the bead of the outer attachment portion 48.

Accordingly, an improved diaphragm for an air driven diaphragm pump is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A diaphragm mechanism for an air driven diaphragm pump, comprising a diaphragm having an air chamber side and a pump chamber side, the diaphragm including an inner attachment portion, an outer attachment portion, an annular flexure portion between the inner attachment portion and the outer attachment portion, an inner transition portion joining the inner attachment portion and the annular flexure portion and an outer transition portion joining the annular flexure portion and the outer attachment portion, the annular flexure portion having a constant radius of curvature as seen in radial cross section, the locus of the center of curvature of the constant radius of curvature being substantially in a plane with the intersection of the inner transition portion and the inner attachment portion, the annular flexure portion being concave on the air chamber side;

structural fabric fully embedded in the diaphragm and extending across the diaphragm closer to the air chamber side than the pump chamber side, the structural fabric being embedded in the air chamber side to about one-third of the thickness of the diaphragm.

2. The diaphragm mechanism of claim 1 further comprising pump chamber structure on the pump chamber side of the diaphragm positioned against the outer attachment portion;

air chamber structure on the air chamber side of the diaphragm positioned against the outer attachment portion;

a diaphragm piston retaining the inner attachment portion.

3. The diaphragm mechanism of claim 1, the diaphragm being molded from material selected from the group consisting of chloroprene, nitrile, ethylene propylene and fluorocarbon.

4. The diaphragm mechanism of claim 1, the diaphragm having concentric ribs on the air chamber side.

5. A diaphragm mechanism for an air driven diaphragm pump, comprising a diaphragm having an air chamber side and a pump chamber side, the diaphragm being molded to define an inner attachment portion, an outer attachment portion, an annular flexure portion between the inner attachment portion and the outer attachment portion, an inner transition portion joining the inner attachment portion and the annular flexure portion and an outer transition portion joining the annular flexure portion and the outer attachment portion, the annular flexure portion having a constant radius of curvature as seen in radial cross section, the locus of the center of curvature of the constant radius of curvature being substantially in a plane with the intersection of the inner transition portion and the inner attachment portion, the annular flexure portion being concave on the air chamber side; structural fabric molded into the diaphragm extending across the diaphragm and being embedded in the air chamber side to about one-third of the thickness of the diaphragm.

6. The diaphragm mechanism of claim 5, the diaphragm being molded from material selected from the group consisting of chloroprene, nitrile, ethylene propylene and fluorocarbon, the selected material being molded about the structural fabric.

7. The diaphragm mechanism of claim 6, the diaphragm having concentric ribs on the air chamber side.

* * * * *